United States Patent [19]

Jeschke

[11] Patent Number: 4,905,595

[45] Date of Patent: Mar. 6, 1990

[54] PROCESS AND PRINTING PRESS TO PRODUCE MULTICOLOR IMPRESSIONS

[75] Inventor: Willi Jeschke, Bad Herrenalb, Fed. Rep. of Germany

[73] Assignee: Heidelberger Druckmaschinen Aktiengesellschaft, Heidelberg, Fed. Rep. of Germany

[21] Appl. No.: 214,637

[22] Filed: Jul. 1, 1988

[30] Foreign Application Priority Data

Jul. 2, 1987 [DE] Fed. Rep. of Germany ..... 3721879

[51] Int. Cl.[4] ..... B41F 5/18; B41F 33/16

[52] U.S. Cl. ..... 101/174; 101/211; 101/246; 101/477; 101/490

[58] Field of Search ..... 101/52, 53, 54, 90, 101/91, 92, 113, 131, 132, 132.5, 246, 136, 137, 142, 144, 477, 174, 211, 490

[56] References Cited

U.S. PATENT DOCUMENTS

| | | | |
|---|---|---|---|
| 3,431,841 | 3/1969 | Tonkin et al. | 101/142 |
| 3,793,950 | 2/1974 | Kaneko et al. | 101/132 |
| 3,874,290 | 4/1975 | Suzuki | 101/132.5 |
| 4,232,602 | 11/1980 | Selman | 101/132 |
| 4,408,530 | 10/1983 | Yano et al. | 101/415 |
| 4,417,514 | 11/1983 | Hoshimo | 101/54 |
| 4,558,216 | 12/1985 | Rodi et al. | 250/223 |
| 4,592,977 | 6/1986 | Naganuma | 430/18 |
| 4,727,807 | 3/1988 | Sumaki et al. | 101/415.1 |

FOREIGN PATENT DOCUMENTS

| | | |
|---|---|---|
| 1507117 | 4/1978 | United Kingdom . |
| 2017004 | 9/1979 | United Kingdom . |

*Primary Examiner*—J. Reed Fisher

*Attorney, Agent, or Firm*—Nils H. Ljungman

[57] ABSTRACT

This invention relates to a process and a printing press for the production of multicolor impressions with several plate cylinders with corresponding inking mechanisms, whereby multicolor printing is made possible in the so-called direct printing process from plate to paper with a plate feed for the flexible printing plates or films and an automatic feed to the impression cylinders. Then the sheets to be printed are introduced via a sheet feed to the impression cylinder, and after the printing has been done, the used printing plates or films are transferred to an ejection apparatus.

16 Claims, 4 Drawing Sheets

PROCESS AND PRINTING PRESS TO PRODUCE MULTICOLOR IMPRESSIONS

BACKGROUND OF THE INVENTION

1. Field of the Invention:

This invention relates to a process for the production of multicolor impressions with several plate cylinders with corresponding inking mechanisms, and to a printing press for the execution of the process.

2. Description of the Prior Art:

A multicolor rotary printing press of the prior art is described in German Patentschrift DE-PS 625,760, in which, for one impression cylinder, there are several plate cylinders, which print the paper sheet fed to them, one after the other, each with one color. For this purpose, there are inking mechanisms corresponding to the plate cylinders. Such printing presses take a long time to set up and can therefore be used economically only for large print runs. German Patentschrift DE-PS 625,760 is incorporated herein by reference.

As a result of the increased use of computers and screens, it would be desirable to reproduce, for example, the multicolor representation of a screen on a sheet of paper. For this purpose, simple printing presses are desired, which preferably work according to the direct printing process and by means of which small print runs can be done in a short time. The printing plates or film could be manufactured simply, rapidly and economically.

OBJECT OF THE INVENTION

In light of the situation described above, the object of the present invention is to create a printing press which has a simple structure, which can print in several colors, and on which the printing plates or films required for the direct printing process from plate to paper can be introduced rapidly and accurately, and can be rapidly removed after a small run has been printed.

SUMMARY OF THE INVENTION

This object is achieved by means of a process for the production of multicolor impressions with several plate cylinders, with corresponding inking mechanisms, in which flexible printing plates or printing films are introduced separately from one another for each color to be printed by a plate feed of a feed roller. The printing plates or films are then transferred by the feed drum to the grippers of the impression cylinder. From the grippers of the impression cylinder, the printing plates or films are respectively transferred accurately one after another to the holding means on each of the plate cylinders. The sheets to be printed are fed from a paper feeder by means of the guide drum to the grippers of the impression cylinder, and are printed one after another by the plate cylinders, and are fed by a delivery apparatus to a delivery stack. After the run has been printed, the printing plates or films are transferred by the holding means of the respective plate cylinders to ejection devices, which are located behind the plate cylinders. When there are four plate cylinders, for example, such a process makes it possible to introduce the required printing plates or films rapidly and accurately, to print the required number of sheets immediately, and then to remove the printing plates from the plate cylinders. A new set of printing plates can then be introduced immediately to print the next run. This means that an accurate multicolor printing run can be accomplished at minimum expense, so that, for example, a multicolor graphic image on a screen could be distributed after only a few minutes to the participants in a meeting.

So that the reverse side of the multicolor printed sheet can also be printed, e.g. with calculations related to the graphic image, there is included a process in which another plate cylinder, which corresponds to the guide drum is provided to produce a second printing. A printing plate or film is accurately fed by the feed drum directly to this other plate cylinder. Behind this other plate cylinder, there is also an ejection apparatus for the used printing plate or film.

The object is achieved by a printing press to execute the process in which an impression cylinder has several times the diameter of a plate cylinder and has several rows of grippers. The impression cylinder has several plate cylinders with inking mechanisms. When viewed in the direction of rotation of the impression cylinder, ahead of the plate cylinders there is a feed drum with a plate feed for the separate introduction of the individual printing plates to the gripper rows of the impression cylinder. Again, when viewed in the direction of rotation of the impression cylinder, behind each plate cylinder there is an ejection apparatus for the no longer needed printing plates or films, whereby the holding means on the plate cylinders release the printing plates or films on command. Still again when viewed in the direction of rotation of the impression cylinder, ahead of the plate cylinders there is a sheet feeder with a guide drum to feed the sheets to the grippers of the impression cylinder. Finally, when viewed in the direction of rotation of the impression cylinders, behind the plate cylinders there is a delivery apparatus for the printed sheet from which the sheets are fed to a delivery stack. With a machine configured in this manner and equipped with a modern control system, the printing can begin immediately after introduction of the printing plates or films. After extraction of the used printing plate or film, the machine is immediately ready to accept the next film, so that even small printing runs can be economically produced. For special applications, it would also be possible to introduce the printing plates using the feed means of the sheet feeder for the individual plate cylinders.

In another configuration, the invention proposes a printing press on which the guide drum for the printed sheets is designed with a printing surface and is in rolling contact with another plate cylinder. This other plate cylinder in turn is in rotating contact with the feed drum for the printing plate or film, whereby the printing plates or films are accurately transferred to the holding means of this other plate cylinder directly from the feed drum. The no longer needed printing plates or films on this other plate cylinder are transferred on command by the holding means to a downstream ejection apparatus, when viewed in the direction of rotation. With this printing press, therefore, the reverse side of the sheet can also be printed. A significant advantage of the invention is that the grippers of the impression cylinder, for example, transport both the printing plates or films and the sheets to be printed.

In a refinement of the invention, a process is proposed in which the printing plates or film feed by means of the plate feed for the individual color extracts are produced by the copying print process — preferably by means of laser printing or a thermal printing process — and the corresponding color separation is produced by programming a computer connected to the screen.

One aspect of the invention resides broadly in a rotary printing press for printing multicolored impressions on sheets, the press including: a rotary impression cylinder having a plurality of evenly distributed impression surfaces thereon; a plurality of gripper devices on the impression cylinder respectively aligned with the impression surfaces, each of the gripper devices capable of selectively gripping and of selectively releasing one of the sheets; a plurality of plate cylinders aligned with the impression cylinder, each of the plate cylinders having a plate holding apparatus; the plate holding apparatus capable of selectively recieving a printing plate; apparatus for providing a first supply of the printing plates; a plate feed drum aligned with the impression cylinder and alignable with each of the plurality of the gripper devices thereon; plate securing apparatus on the plate feeding drum for selectively receiving one of the printing plates thereon and for selectively releasing one of the printing plates therefrom; apparatus for sequentially transferring each of the printing plates from the first supply to the plate securing apparatus on the plate feed drum to cause one of the printing plates to be plate feed drum when released thereby, the impression cylinder rotates each of the gripper devices with one of the printing plates thereon from the plate feed drum to a selected one of the plurality of the plate cylinders; each of the gripper devices releases one of the printing plates and the plate holding apparatus of the selected one of the plate cylinders receives one of the printing plates; an inking mechanism aligned with each of the plate cylinders to provide ink to one of the printing plates secured by the plate holding apparatus; apparatus for stacking a plurality of the sheets; apparatus for sequentially guiding one of the sheets from the apparatus for stacking to each of the gripper devices for gripping thereby after each one of the printing plates is on the selected one of the plate cylinders; the impression cylinder with one of the sheets gripped by the gripper device rotated past each of the plate cylinders, each of the plate cylinder having one of the printing plates from the first supply secured thereon by the plate holding apparatus to cause printing of one of the sheets; and an apparatus for collecting one of the sheets upon release of one of the sheets by each of the gripper devices after the impression cylinder and one of the sheets thereon have rotated past each of the plate cylinders.

Another aspect of the invention resides broadly in a method of printing multicolored impressions on a plurality of sheets on a rotary printing plates including: a rotary impression cylinder having a plurality of evenly distributed impression surfaces thereon; a plurality of gripper devices on the impression cylinder respectively aligned with the impression surfaces; a plurality of plate cylinders aligned with the impression cylinder, and each of the plate cylinders having a plate holding means and an inking mechanism, the method comprising the steps of: providing a first supply of printing plates; rotating the impression cylinder and the plate cylinders; sequentially feeding each of the printing plates from the first supply to a respective one of the gripper devices; transferring each of the printing plates from the respective one of the gripper devices to the plate holding apparatus of a corresponding one of the plate cylinders; respectively feeding each sheet of the plurality of sheets to each of the gripper devices; printing each sheet by each of the printing plates as each sheet rotates past each of the plate cylinders; and removing each sheet from each of the gripper devices after printing.

Still yet another aspect of the invention resides broadly in a rotary printing press for printing on sheets, the press including: a rotary impression cylinder having at least one impression surface thereon; at least one gripper device on the impression cylinder aligned with the at least one impression surface, each of the at least one gripper devices capable of selectively gripping and of selectively releasing one of the sheets; at least one plate cylinder aligned with the impression cylinder; at least one plate cylinder having plate holding apparatus; the plate holding apparatus capable of selectively receiving a printing plate; apparatus for providing a first supply of at least one printing plate; a plate feed drum aligned with the impression cylinder and being alignable with the at least one gripper devices thereon; plate securing apparatus on the plate feeding drum for selectively receiving one of the at least one printing plate thereon and for selectively releasing one of the printing plates therefrom; apparatus for transferring at least one printing plate the first supply to the plate securing apparatus on the plate feed drum to cause one of the at least one printing plate to be received thereon, each of the at least one gripper devices capable of selectively gripping and of selectively releasing one of the at least one printing plate, each of the at least one gripper devices for gripping one of the at least one printing plate from the plate securing apparatus on the plate feed drum when released thereby; the impression cylinder having an apparatus for rotating each of the at least one gripper devices with one of the at least one printing plates thereon from the plate feed drum to a selected one of the at least plate cylinders; each of the gripper devices having an apparatus for releasing one of the at least one printing plate and the plate holding apparatus of the selected one of the plates cylinders receiving one of the at least one printing plate; an inking mechanism aligned with each of the at least one plate cylinder to provide ink to one of the at least one printing plates secured by the plate holding apparatus on each of the at least one plate cylinder; apparatus for stacking a plurality of the sheets; apparatus for sequentially guiding one of the sheets from the means for stacking to each of the at least one gripper device for gripping thereby after each one of the at least one printing plates is on its one of the at least one plate cylinders; the impression cylinder with one of the sheets gripped by the at least one gripper devices rotated past each of the at least one plate cylinder, each of the at least one plate cylinder having its corresponding one of the at least one plate cylinder having its corresponding one of the at least one printing plate from the first supply secured thereon by the plate holding apparatus to cause printing of one of the sheets; and an apparatus for collecting one of the sheets upon release of one of the sheets by its corresponding one gripper device after the impression cylinder and one of the sheets thereon have rotated past each of the at least one plate cylinder.

BRIEF DESCRIPTION OF THE DRAWINGS

The embodiments of the invention are schematically illustrated in the accompanying drawing.

DESCRIPTION OF THE PREFERRED EMBODIMENTS

Figure 1:
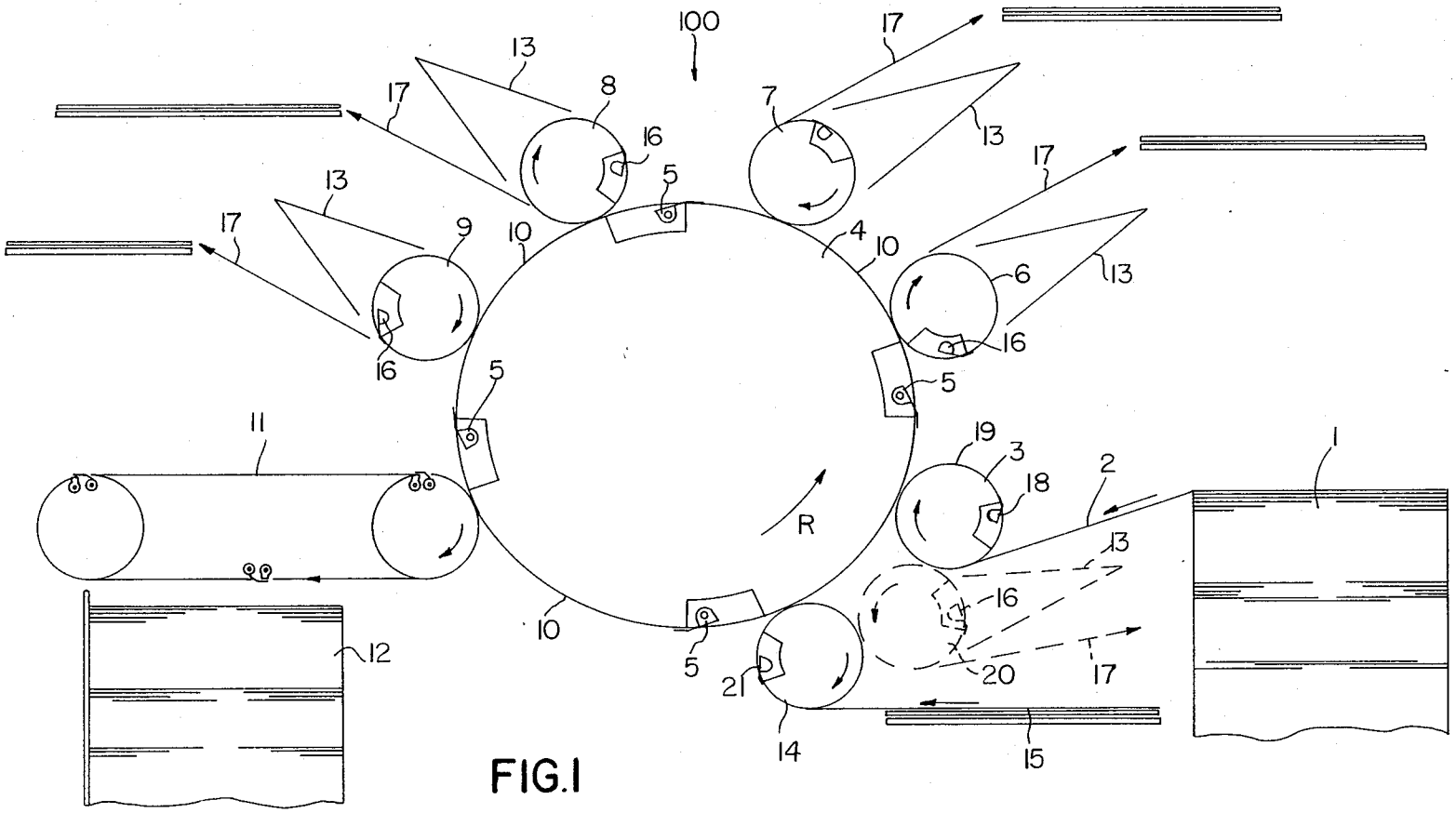
FIG. 1 is a schematic view of the preferred printing press including various features of the invention.
Figure 2:
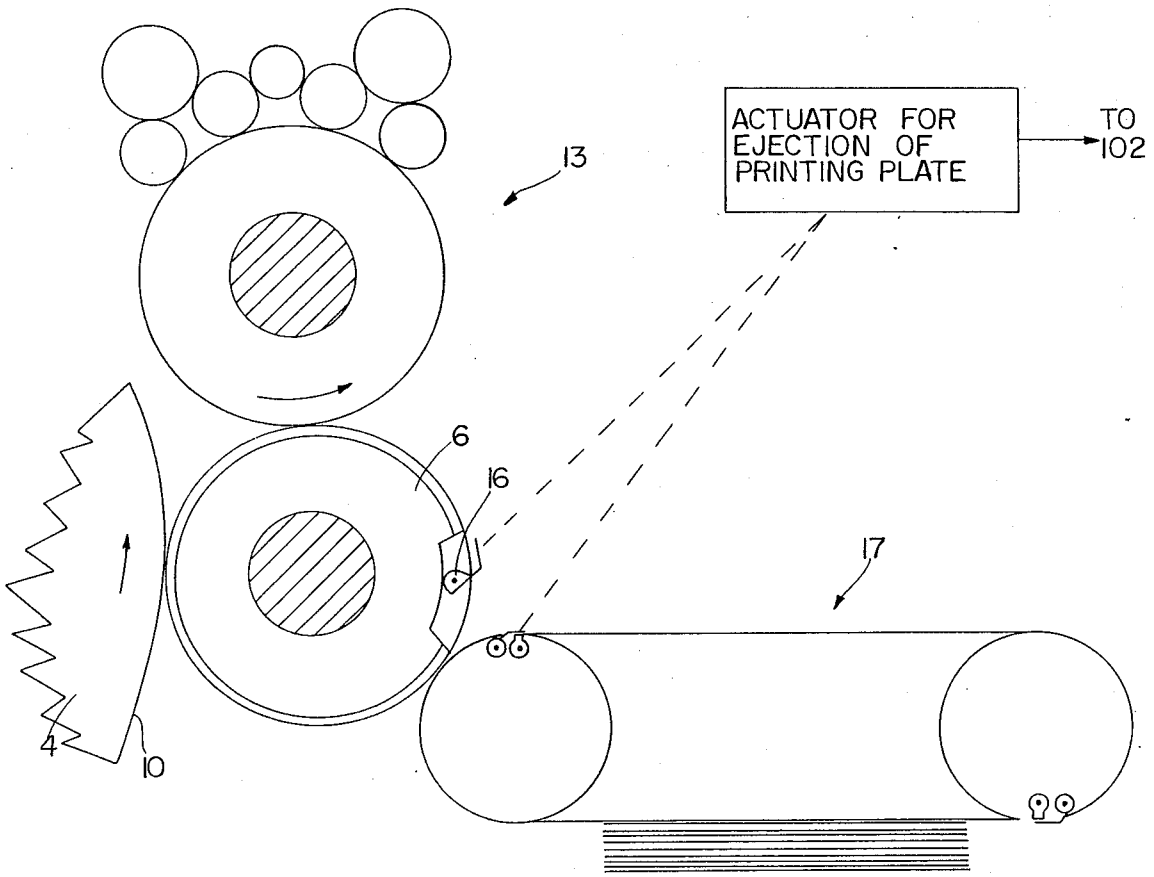
FIG. 2 is an enlarged schematic view of one of the plate cylinders of FIG. 1.

On the illustrated printing press 100 as seen in FIGS. 1 and 2, the sheets to be printed are fed from a sheet stack 1 via a sheet feeder 2 and a guide drum 3 to the impression cylinder 4. The series of grippers 5 on the impression surfaces 10 of the impression cylinder 4 pick up the fed sheets and move them in the direction of rotation R of the impression cylinder 4. Each sheet is rotated under the plate cylinders 6, 7, 8 and 9, whereby each plate cylinder produces a specified color impression on the printed sheet, so that a four-color impression is produced by the four plate cylinders. For this purpose, the sheets to be printed are placed in contact with the impression surfaces 10 of the impression cylinder 4, downstream of the rows of grippers 5. After the printing has been done, the printed sheets are transferred to a delivery apparatus 11 and are transported by the latter to the delivery stack 12.

As shown in FIGS. 1 and 2, the impression cylinder 4 is equipped with four rows of grippers 5, and its diameter is four times that of each of the plate cylinders 6 to 9. Corresponding to each plate cylinder 6 to 9 there is a schematically illustrated inking mechanism 13. Viewed in the direction of rotation of the impression cylinder 4, ahead of the plate cylinders 6 to 9 and ahead of the guide drum 3, the impression cylinder 4 has an aligned feed drum 14, which includes a plate securing holder 21 which is capable of selectively holding and selectively releasing a printing plate on the feed drum 14.

Individually and one after another, the individual printing plates are introduced by a plate feed 15 to the feed drum 14. The plate feed 15 can function in a similar manner as the sheet stack 1 and sheet feeder 2 or in any other manner which is well known in the printing art. The feed drum 14, in turn, respectively transfers the printing plates to the gripper rows 5 of the impression cylinder 4. From there they are then transferred one after another for the printing of the individual colors to the holding means 16 of the plate cylinders 6, 7, 8 and 9. The holding means 16 can be gripper devices, for example, which work together with the gripper rows 5 of the impression cylinder. The gripper rows 5 of the impression cylinder 4 are controlled so that they feed the corresponding printing plate to the correct plate cylinder, i.e. the printing plate which makes the yellow impression is fed to the plate cylinder with the yellow inking, and the other printing plates correspondingly. During the printing, the control of the gripper rows 5 is switched so that they receive the sheets to be printed from the guide drum 3 and transfer them to the delivery apparatus 11 after printing.

As soon as the desired number of sheets has been printed, the no longer needed printing plates or films are transferred in response to a command by the holding means 16 on the plate cylinders 6 to 9 to ejection devices 17, so that a new printing plate can be introduced. From the ejection devices 17, the used printing plates can be transported to a disposal container, for example.

As best seen in FIG. 2, an enlarged, schematic view of one of the plate cylinders 16 demonstrates the general relationship of the plate cylinder 16 to a inking mechanism 13 and ejection apparatus 17. Generally, the inking mechanism and/or the ejection apparatus may be provided in the form as shown or may include an alternative configuration well known in the printing art. There is included in FIG. 2 an actuator for ejection of the printing plate from the holder 16 to the ejection apparatus 17 which is basically controlled by the timing and controlling system for printing and for exchanging printing plates 102 which will be discussed in detail hereinbelow.

In another configuration of the invention, the guide drum 3 can be designed to have an impression surface downstream of the transfer grippers 18. It is then possible to assign to the guide drum 3 another plate cylinder 20, which also has an inking mechanism 13. This plate cylinder 20 is in moving contact with the guide drum 3 and can produce in the area of the impression surface 19 of the guide drum an impression on the reverse side of the sheets fed to it, so that when complete, the printed sheet has a four-color impression on the front and a single-color impression on the back.

To introduce the printing plates for printing on the back of the sheets, this plate cylinder 20 can be in rolling contact with the feed drum 14, so that the necessary printing plate is transferred directly to it. For this purpose, the plate cylinder 20 also has holding means 16, by which, after the printing has been done, the no longer needed printing plates or films are transferred directly to the ejection apparatus 17, which is directly downstream seen in the direction of rotation. The command to eject can be given, for example, as a function of the signal to turn off the sheet feed. The plate securing holder 21 on the feed drum 14 hereby works together with the rows of grippers 5 on the impression cylinder 4 and with the holding means 16 on the plate cylinder 20.

Basically, the no longer needed printing plates or films can also be carried away by the rows of grippers 5 on the impression cylinder 4, but that would mean that between the printing surface 10 of the impression cylinder 4 and the inked printing plate or film, there would have to be a waste sheet, which could then be transported to the disposal facility, just like the printing plates or films.

In this configuration, the sheet feeder 2 would always feed a sheet to the printing surface 10. The no-longer-needed printing plate of a plate cylinder would be deposited on the sheet. To hold the printing plate on the sheet and the printing surface 10, there could be a special holding means, e.g. a second gripper row. Both the printing plate and the underlying sheet would then be fed via the feed apparatus 11 to the delivery stack 12. The printing press operator could then easily remove and discard both of them.

As described above, the preferred printing machine provides a method for producing multicolor impressions with several plate cylinders 6–9 with corresponding inking mechanisms 13. Flexible printing plates or films are introduced one after another separately for each color to be printed by a plate feed 15 to a feed drum 14. The printing plates or films are then transferred from the feed drum 14 to the gripper rows 5 of the impression cylinder 4. From the grippers of the impression cylinder 4, the printing plates or films are accurately transferred one after another to the holders 16 on the plate cylinders 6–9. The sheets to be printed are introduced by a sheet feed 2 via the guide drum 3 to the grippers of the impression cylinder 4. The sheets are printed one after another by the plate cylinders 6–9 and are then fed by a delivery apparatus 11 to a delivery stack 12. After the run has been printed, the printing plates or films are transferred by the holding means 16 of the plate cylinders 6–9 to ejection devices 17, which are located downstream of the plate cylinders 6–9.

The printing method can also include the guide drum 3 having another plate cylinder 20 to produce a second impression. The printing plate or film for the second impression is fed directly from the feed drum 14 to this plate cylinder 20. Downstream of this plate cylinder 20 there is also an ejection apparatus 17 for the used printing plates or films.

Generally, the preferred printing press includes an impression cylinder 4 which is several times the diameter of a plate cylinder and is equipped with several gripper rows 5. Corresponding to the impression cylinder 4 there are several plate cylinders 6–9 with inking mechanisms 13, in which, when viewed in the direction of rotation of the impression cylinder 4, ahead of the plate cylinders 6–9 there is a feed drum 14 with a plate feed 15 for the separate introduction of the individual printing plates to the gripper rows 5 of the impression cylinder 4. Downstream of each plate cylinder 6–9 there is an ejection apparatus 17 for the no longer needed printing plates of films, whereby the holders 16 on the plate cylinders 6–9 release the printing plates or films on command. Upstream of the plate cylinders 6–9 there is a sheet feeder 2 with a guide drum 3 to feed the sheets to the gripper rows 5 of the impression cylinder 4 and in which, when viewed in the direction of rotation of the impression cylinder 4, downstream of the plate cylinders 6–9 there is a delivery apparatus 11 for the printed sheet, from which the sheet is fed to a delivery stack 12.

It is also possible for the guide drum 3 for the sheets is to be designed with an impression surface 19 downstream of the transfer grippers 18. The guide drum 3 is in rolling contact with another plate cylinder 20 and the plate cylinder 20 in turn is in rolling contact with the feed drum 14 for the printing plates. The printing plates or films are accurately transferred to the holders means 16 of this plate cylinder 20 directly from the feed drum 14. On command, the no longer needed printing plates or films are transferred from the holders 16 to a downstream ejection apparatus 17.

In the printing method taught herein, the printing plates or films for the individual color separations introduced via the plate feed 15 could be produced by the copying process, preferably by means of laser printing or in a thermal process. The corresponding color separation could be produced by programming a computer corresponding to the screen.

Figure 3:
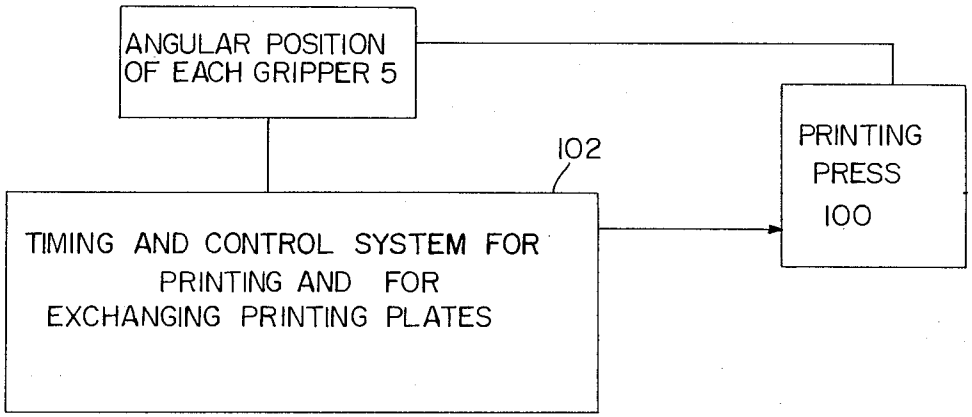
FIG. 3 is a block diagram of the preferred timing and control system for the preferred printing press.

As shown in FIG. 3, the overall operation of the printing press 100 is basically regulated by a timing and control system for printing and for exchanging printing plates 102. For proper operation of the timing and control system 102, it is significant that the angular position of each gripper 5 be preferably included in order to properly present each of the printing plates to the proper plate cylinder 6–9.

Figure 4:
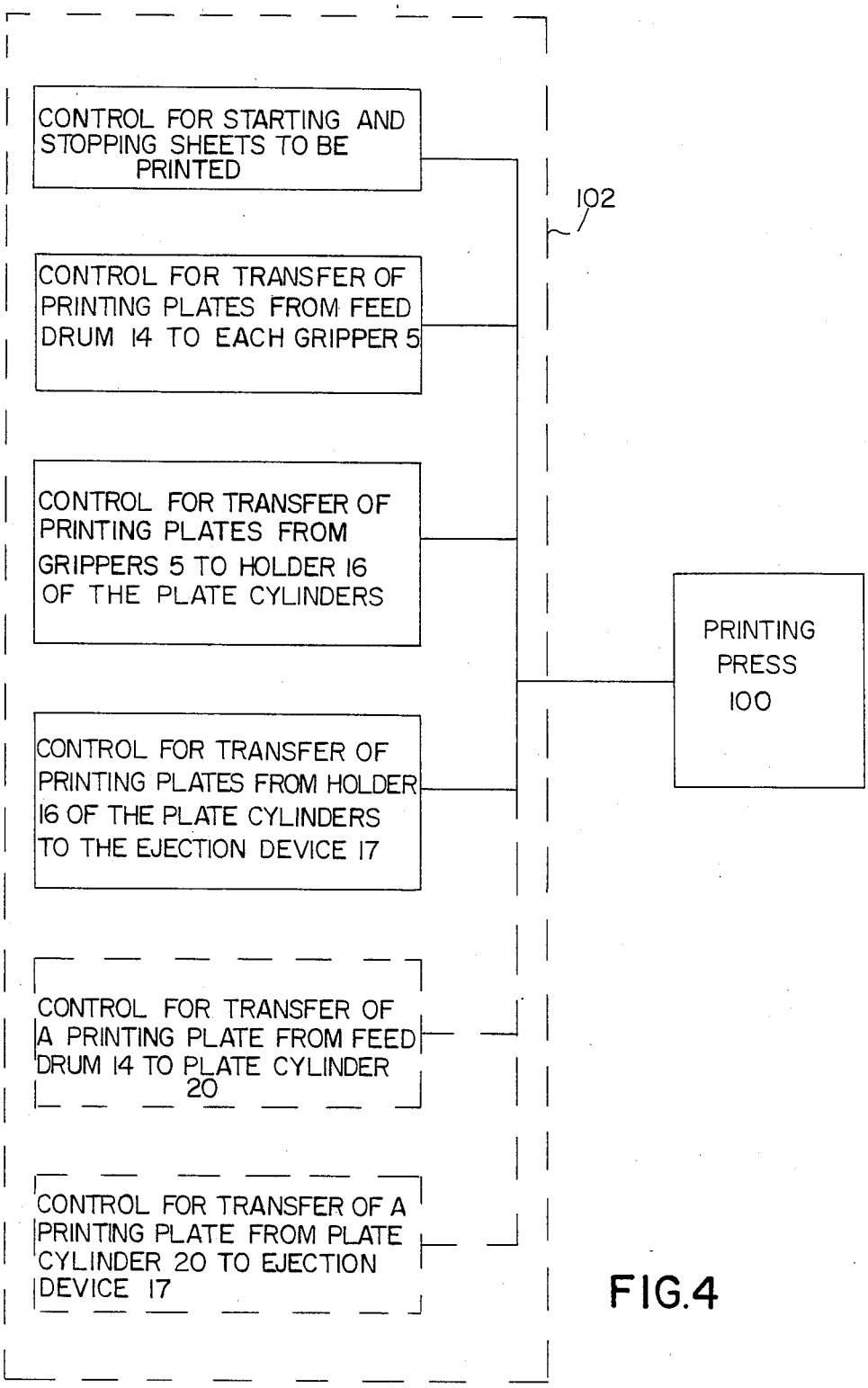
FIG. 4 is a block diagram indicating some of the functions of the preferred timing and control system for the preferred printing machine including various features of the invention.

As seen in more detail in FIG. 4, the timing and control system 102 includes various controls for insuring proper introduction of and transfer of the sheets through the printing press 100. Additionally, proper introduction and transfer of the printing plates to the plate cylinders is essential in order for the next supply of sheets to be properly printed. It is also significant that there be control means for insuring that the printing plates which are no longer desired on the plate cylinders be properly transferred to the ejection devices prior to the introduction of new printing plates to the plate cylinders.

For example, after the sheets to be printed are stopped, printing plates from the plate feed 15 are provided to the feed drum 14 for alignment with a particular gripper 5 on the impression cylinder 4. The array of printing plates would be stacked in a specific order and, with a specific orientation to insure that they are each respectively positioned for advancement to the correct plate cylinder having ink which corresponds to the image on the printing plate. The particular gripper 5 receiving each specific printing plate is significant since each specific printing plate is to be transferred to a corresponding plate cylinder having the corresponding color of ink in the inking mechanism 13. Accordingly, after the particular gripper 5 has received a printing plate therein, it is transferred by the rotation of the impression cylinder 4 to the one plate cylinder 6, 7, 8 or 9 having that colored inking mechanism 13. When the gripper 5 is properly aligned with its proper plate cylinder 6, 7, 8 or 9, the control will cause transfer of the printing plate from the gripper 5 to the holder 16 of the plate cylinder. When all such printing plates have been transferred to their corresponding plate cylinders, the control for starting the sheets can be activated to cause printing of the sheets by the printing press 100.

At the completion of a run, the sheets are no longer fed to the printing press 100 and the controls are utilized to transfer each of the printing plates from its respective plate cylinder to its respective ejection device 17. After the ejection of each of the printing plates, new printing plates can be introduced through the same control system to the appropriate plate cylinder therefore for the eventual printing of the sheets once the sheets are again introduced to the impression cylinder 4 from the guide drum 3.

If the additional feature of the additional plate cylinder 20 is employed, the controls also include means for transferring the additional printing plate from the feed drum 14 to the additional plate cylinder 20. Similarly, after the completion of printing, where the plate cylinder 20 produced printing on the backsides of the sheets, the controls would cause the transfer of the printing plate from the plate cylinder 20 to the ejection device 17 thereof, in order to receive another printing plate for printing on the back of the sheets of the next quantity to be printed.

A number of patents disclose printing presses and include details of various components used in the printing field.

British Pat. No. 1,507,117, entitled "Sheet Conveyor Apparatus", discloses sheet positioning and gripping apparatus and is incorporated herein by reference.

U.S. Pat. No. 3,431,841, entitled "Offset Duplicating Machines with Master Loading and Ejecting Mechanisms", discloses method and apparatus for loading and ejecting a master in an offset duplicating machine and is incorporated herein by reference.

British patent application No. 2,017,004, entitled "Rotary Multi-Colour Printing Machine", discloses a basic four color printing machine and is incorporated herein by reference.

U.S. Pat. No. 4,558,216, entitled "Safety Device for Determining Improper Takeover of Sheets by a Blanket Cylinder", discloses a rotary printing machine and is incorporated herein by reference.

U.S. Pat. Nos. 4,408,530, entitled "Automatic Printing Plate Exchange System"; 4,417,514, entitled "Printing Plate Exchange System"; and 4,727,807, entitled "Apparatus for Automatically Mounting and Removing Printing Plates in Rotary Printing Press", each disclose specific means for exchanging printing plates in a printing machine. These patents are incorporated herein by reference.

U.S. Pat. No. 4,592,977, entitled "Lithographic Printing Plate", discloses a means for producing a printing plate and is incorporated herein by reference.

A number of other patents disclose printing machines and, among other features, the control of various gripper system therefor. These patents include: U.S. Pat. No. 3,929,069, entitled "Gripper Control for Sheet-Fed Rotary Printing Presses"; U.S. Pat. No. 4,003,310, entitled "Control Apparatus for Gripper Finger Shaft for Printing Presses"; U.S. Pat. No. 4,031,824, entitled "Sheet Feed and Takeoff Assembly for printers"; U.S. Pat. No. 4,147,105, entitled "Protective Device for a Perfector Printing Press"; and U.S. Pat. No. 4,582,316, entitled "Device for Withdrawing Printed Sheets for Examination or Sorting Purposes", which are incorporated herein by reference.

U.S. Pat. No. 3,942,787, entitled "Sheet Feeding Apparatus for Printing Presses", and U.S. Pat. No. 4,522,388, entitled "Arrangement for Applying Compressed Air to Underside of Sheet on Feed Table of Printing Presses", disclose sheet feeding devices and are incorporated herein by reference.

The above-mentioned patents are incorporated by reference as if the contents thereof were set forth in their entirety herein.

From the preferred embodiment discussed hereinabove, it should be clear that alterations could be made to the invention without departing from the scope of the invention as claimed.

The invention as described hereinabove in the context of a preferred embodiment is not to be taken as limited to all of the provided details thereof, since modifications and variations thereof may be made without departing from the spirit and the scope of the invention.

What is claimed is:

1. A rotary printing press for printing multicolored impression on sheets, said press comprising:

a rotary impression cylinder having a plurality of evenly distributed impression surfaces thereon;

a plurality of gripper means on said impression cylinder respectively aligned with said impression surfaces;

each of said gripper means being capable of selectively gripping and of selectively releasing one of the sheets;

a plurality of plate cylinders aligned with said impression cylinder;

each of said plate cylinders having plate holding means;

said plate holding means being capable of selectively receiving a printing plate;

means for providing a first supply of said printing plates;

a plate feed drum aligned with said impression cylinder and being alignable with said each of said plurality of said gripper means thereon;

plate securing means on said plate feeding drum for selectively receiving one of said printing plates thereon and for selectively releasing said one of said printing plates therefrom;

means for sequentially transferring each of said printing plates from said first supply to said plate securing means on said plate feed drum to cause said one of said printing plates to be received thereon;

said each of said gripper means being capable of selectively gripping and of selectively releasing said one of said printing plates;

said each of said gripper means being operable for gripping said one of said printing plates from said plate securing means on said plate feed drum when released thereby;

said impression cylinder being operable for rotating said each of said gripper means with said one of said printing plates thereon from said plate feed drum to a selected one of said plurality of said plate cylinders;

said each of said gripper means being operable for releasing said one of said printing plates and said plate holding means of said selected one of said plate cylinders being for receiving said one of said printing plates;

an inking mechanism aligned with said each of said plate cylinders to provide ink to said one of said printing plates secured by said plate holding means;

means for stacking a plurality of said sheets;

means for sequentially guiding said one of the sheets from said means for stacking to said each of said gripper means for gripping thereby after each said one of said printing plates is on said selected one of said plate cylinders;

said impression cylinder with said one of the sheets gripped by said gripper means being rotated past each of said plate cylinders;

said each of said plate cylinders having said one of said printing plates from said first supply secured thereon by said plate holding means to cause printing of said one of the sheets; and means for collecting said one of said sheets upon release of said one of the sheets by said each of said gripper means after said impression cylinder and said one of the sheets thereon have rotated past said each of said plate cylinders.

2. The rotary printing press according to claim 1, wherein said plurality of said plate cylinders includes four of said plate cylinders, said plurality of said gripper means on said impression cylinder includes four of said gripper means, said each of said plate cylinders includes one of said plate holding means thereon, said plate feed drum includes one of said plate securing means thereon, and said first supply of said printing plates includes four of said printing plates.

3. The rotary printing according to claim 1, further including:

means for selectively stopping and starting guiding by said means for sequentially guiding said one of said sheets;

said plate holding means of said each of said plate cylinders being capable of selectively releasing said one of said printing plates;

means for removing each said one of said printing plates from said plate holding means of said selected one of said plate cylinders after stopping said guiding of sheets by said means for sequentially guiding;

means for providing a second supply of said printing plates;

means for sequentially transferring each of said printing plates from said second supply to said plate feed drum;

said each of said printing plates from said second supply being subsequentially transferred to said plate holding means of said selected one of said plate cylinders in the same manner as said one of said printing plates from said first supply; and said one of the sheets being printed by said each of said printing plates from said second supply respectively secured on said each of said plate cylinders after said starting of said means for sequentially guiding.

4. The rotary printing press according to claim 3, wherein said plurality of said plate cylinders includes four of said plate cylinders, said plurality of said gripper means on said impression cylinder includes four of said gripper means, said each of said plate cylinders includes one of said plate holding means thereon, said plate feed drum includes one of said plate securing means thereon, and each of said first supply and said second supply of said printing plates includes four of said printing plates.

5. The rotary printing press according to claim 1, wherein said printing of said one of the sheets by said each of said plate cylinders is on a first side thereof and said means for guiding said one of the sheets includes a guide drum having an impression surface; further including:

an additional plate cylinder;

said additional plate cylinder having said plate holding means and said inking mechanism similar to those of said each of said plate cylinders;

means for providing an additional printing plate in said first supply;

said additional plate cylinder being aligned with said plate feed drum and with said means for guiding said one of said sheets;

said means for sequentially transferring said each of said printing plates including transferring said additional printing plate from said first supply to said plate securing means on said plate feed drum for receipt thereby;

said plate holding means on said additional plate cylinder receiving said additional printing plate upon release by said plate securing means on said plate feed drum; and said additional printing plate being capable of printing a second side as each of the sheets passes between said additional plate cylinder and said impression surface of said means for guiding the sheets.

6. The rotary printing press according to claim 5, further including means for selectively stopping said means for sequentially guiding said one of said sheets and means for removing said additional printing plate from said additional plate cylinder after stopping of said means for sequentially guiding.

7. A method of printing multicolored impressions on plurality of sheets on a rotary printing press including: providing a rotary impression cylinder having a plurality of evenly distributed impression surfaces thereon; a plurality of gripper means on said impression cylinder respectively aligned with said impression surfaces; a plurality of plate cylinders aligned with said impression cylinder; and each of said plate cylinders having plate holding means and an inking mechanism; said method comprising the steps of:

providing a first supply of printing plates;

rotating said impression cylinder and said plate cylinders;

sequentially feeding each of said printing plates from said first supply to a respective one of said gripper means;

transferring said each of said printing plates from said respective one of said gripper means to said plate holding means of a corresponding one of said plate cylinders;

respectively feeding each sheet of said plurality of sheets to each of said gripper means;

printing said each sheet by said each of said printing plates as said each sheet rotates past each of said plate cylinders; and removing said each sheet from said each of said gripper means after said printing.

8. The method of printing as set forth in claim 7, further including stopping said feeding of sheets to said gripper means;

removing said each of said printing plates from said corresponding one of said plate cylinders;

providing a second supply of said printing plates;

feeding each of said printing plates from said second supply to said respective one of said gripping means for said transferring to its corresponding one of said plate cylinders; and starting said respectively feeding of said each sheet of said plurality of sheets for said printing and said removing.

9. The method of printing as set forth in claim 7, wherein said sequentially feeding said each of said printing plates includes advancing said each of said printing plates to a rotating feed drum aligned with said impression cylinder and having plate securing means thereon, securing said each of said printing plates with said plate securing means for rotation by said feed drum to said respective one of said gripper means, and releasing said each of said printing plates from said plate securing means to said respective one of said gripping means to be gripped thereby.

10. The method of printing as set forth in claim 7, wherein said respectively feeding said each sheet includes advancing said each sheet to a rotating guide drum aligned with said impression cylinder and having a guide gripper thereon, gripping said each sheet with said guide gripper for rotation by said guide drum to said each of said gripper means, and releasing said each sheet from said guide gripper to said each of said gripper means to be gripped thereby.

11. The method of printing as set forth in claim 7, wherein said impression cylinder has four of said gripper means, said plurality of said plate cylinders includes four of said plate cylinders, said first supply of said printing plates includes four of said printing plates, and said sequentially feeding said each of said printing plates and said transferring said each of said printing plates includes the steps of:

feeding a first of said printing plates to a first of said gripper means; transferring said first of said printing plates from said first of said gripper means to said plate holding means on a first of said plate cylinders;

feeding a second of said printing plates to a second of said gripper means;

transferring said second of said printing plates from said second of said gripper means to said plate holding means of a second of said plate cylinders;

feeding a third of said printing plates to a third of said gripper means;

transferring said third of said printing plates from said third of said gripper means to said plate holding means of a third of said plate cylinders;

feeding a fourth of said printing plates to a fourth of said gripper means; and transferring said fourth of said printing plates from said fourth of said gripper means to said plate holding means of a fourth of said plate cylinders;

12. The method of printing as set forth in claim 8, wherein said removing said each of said printing plates includes releasing said printing plate from said plate holding means and ejecting said each of said printing plates away from said corresponding one of said plate cylinders.

13. The method of printing as set forth in claim 9, wherein said respective feeding said each sheet includes advancing said each sheet to a rotating guide drum aligned with said impression cylinder and having a guide gripper thereon, gripping said each sheet with said guide gripper for rotation by said guide drum to said each of said gripper means, and releasing said each sheet from said guide gripper to said each of said gripper means to be gripped thereby.

14. The method of printing as set forth in claim 13, wherein said printing press includes an additional plate cylinder aligned between said guide drum and said feed drum, said additional plate cylinder includes plate holding means and an inking mechanism;

said first supply of said printing plates includes an additional printing plate, said printing said each sheet being on a first side thereof, further including the steps of:

advancing said additional printing plate to said rotating feed drum;

securing said additional printing plate with said plate securing means for rotation by said feed drum to said additional plate cylinder;

releasing said additional printing plate from said plate securing means to said plate holding means of said additional plate cylinder; and printing said each sheet on a second side thereof by said additional printing plate on said additional plate cylinder as said each sheet passes between said additional plate cylinder and said guide drum.

15. The method of printing as set forth in claim 14, further including the steps of stopping said respectively feeding of said each sheet and removing said additional printing plate after said stopping said respectively feeding of said each sheet.

16. A rotary printing press for printing on sheets, said press comprising:

a rotary impression cylinder having at least one impression surface thereon;

at least one gripper means on said impression cylinder aligned with said at least one impression surface;

each of said at least one gripper means being capable of selectively gripping and of selectively releasing one of the sheets;

at least one plate cylinder aligned with said impression cylinder;

said at least one plate cylinder having plate holding means;

said plate holding means being capable of selectively receiving a printing plate;

means for providing a first supply of at least one printing plate;

a plate feed drum aligned with said impression cylinder and being alignable with said at least one gripper means thereon;

plate securing means on said plate feeding drum for selectively receiving one of said at least one printing plate thereon and for selectively releasing said one of said printing plates therefrom;

means for transferring at least one printing plate from said first supply to said plate securing means on said plate feed drum to cause said one of said at least one printing plate to be received thereon;

said each of said at least one gripper means being capable of selectively gripping and of selectively releasing said one of said at least one printing plate;

said each of said at least one gripper means being operable for gripping said one of said at least one printing plate from said plate securing means on said plate feed drum when released thereby;

said impression cylinder having means for rotating said each of said at least one gripper means with said one of said at least one printing plates thereon from said plate feed drum to a selected one of said at least one plate cylinders;

said each of said gripper means having means for releasing said one of said at least one printing plate and said plate holding means of said selected one of said plate cylinders being operable for receiving said one of said at least one printing plate;

an inking mechanism aligned with said each of said at least one plate cylinder to provide ink to said one of said at least one printing plates secured by said plate holding means on said each of said at least one plate cylinder;

means for stacking a plurality of said sheets;

means for sequentially guiding one of the sheets from said means for stacking to said each of said at least one gripper means for gripping thereby after each said one of said at least one printing plates is on its one of said at least one plate cylinders;

said impression cylinder with said one of the sheets gripped by said at least one gripper means being rotated past each of said at least one plate cylinders;

said each of said at least one plate cylinder having its corresponding one of said at least one printing plate from said first supply secured thereon by said plate holding means to cause printing of said one of the sheets; and means for collecting said one of said sheets upon release of said one of the sheets by its corresponding one gripper means after said impression cylinder and said one of the sheets thereon have rotated past said each of said at least one plate cylinder.

* * * * *